United States Patent [19]

Crummett

[11] 4,107,642

[45] Aug. 15, 1978

[54] POTENTIOMETER JOYSTICK

[75] Inventor: James G. Crummett, San Jose, Calif.

[73] Assignee: Atari, Inc., Sunnyvale, Calif.

[21] Appl. No.: 768,280

[22] Filed: Feb. 14, 1977

[51] Int. Cl.[2] ..... H01C 10/16

[52] U.S. Cl. ..... 338/128; 338/44; 338/94; 338/156

[58] Field of Search ..... 338/128, 44, 54, 27, 338/151, 156, 38, 80, 222; 74/471 XY; 200/61.47, 61.52, 81.9 HG

[56] References Cited

U.S. PATENT DOCUMENTS

| | | | |
|---|---|---|---|
| 1,609,191 | 11/1926 | Podell | 338/151 |
| 3,299,389 | 1/1967 | Vercesi et al. | 338/142 X |
| 3,711,811 | 1/1973 | Oka et al. | 338/128 |

FOREIGN PATENT DOCUMENTS

| | | | |
|---|---|---|---|
| 235,131 | 3/1945 | Switzerland | 338/156 |
| 473,223 | 12/1975 | U.S.S.R. | 338/94 |

*Primary Examiner*—C. L. Albritton
*Attorney, Agent, or Firm*—Flehr, Hohbach, Test, Albritton & Herbert

[57] ABSTRACT

A joystick comprising a control handle within which is located an inclination sensitive potentiometer. The potentiometer includes an elongate resistance element and an electrically conductive liquid wiper. Movement of the potentiometer causes the wiper to flow along the resistance element and to vary the output resistance of the potentiometer.

1 Claim, 5 Drawing Figures

POTENTIOMETER JOYSTICK

BACKGROUND OF THE INVENTION

1. Field of the Invention

The present invention generally relates to manually operated joysticks and, in particular, to joysticks incorporating potentiometers.

2. Description of the Prior Art

A joystick is an apparatus for converting the manual input commands from a human operator into corresponding outputs that can be used to control the position of machines and the images in visual displays. A typical joystick has a control handle that is received in a ball and socket joint and can be manipulated in a solid angle by the operator. The joystick has a fixed mounting for its axis of rotation and outputs are generated according to the direction and the amount of inclination of the control handle.

In some joysticks the control handle is connected to two potentiometers through a linkage. Movement of the control handle is resolved by the linkage into two perpendicular directions. Motion in each direction is measured by a potentiometer and corresponding resistance values are generated. These resistance values are measured by a voltage dividing network. In other joysticks the control handle is connected to an inclination sensitive potentiometer. The inclination potentiometer type joystick measures the displacement of the control handle from the vertical and resistance values corresponding to this displacement are generated. These resistance values are also measured by a voltage dividing network.

Prior inclination potentiometers used in joysticks have either incorporated pendulums or have taken the form of electrolytic voltage sources. In the pendulum actuated potentiometers a heavy weight is attached to the wiper and swings the wiper across the resistance element during actuation. The input motion rotates the resistance element, and the heavy weight always seeks the vertical. The output of the potentiometer is a changing resistance that corresponds to the amount of inclination of the resistance element. In the electrolytic cell potentiometer a container having a plurality of plates is filled with an electrolytic solution. A voltage is developed across the cell by the chemical reaction between the plates and the solution. The plates have a geometry and are positioned within the container so that the plates are either immersed or withdrawn from the fluid as the container is inclined. Thus, as inclination of the cell varies the immersion of the plates, the voltage generated by the cell changes in a corresponding manner.

Heretofore potentiometer joysticks have tended to be expensive because a complex linkage was required in order to resolve the operator's manual input into motion of the wiper. In addition, most of these potentiometers have parts that must rub against each other and are thereby subject to wear. The contact between the resistance element and the wiper is also subjected to arcing where high voltages are used.

Joysticks incorporating inclination sensitive potentiometers have also tended to be expensive because of their complexity. In addition, those joysticks that incorporate pendulums are large in size and cannot be readily adapted into a small hand-held unit.

SUMMARY OF THE INVENTION

The primary object of the present invention is to overcome the limitations and disadvantages of the prior art.

An additional object of the present invention is to eliminate the need for expensive and complex potentiometers in joysticks, and to provide a simple, low-cost voltage divider.

Still another object of the present invention is to increase the life of a potentiometer joystick by reducing the amount of physical wear and rubbing contact between its parts.

An additional object of the present invention is to provide a low-cost, durable, inclination sensitive potentiometer type joystick.

A further object of the present invention is to provide an improved joystick that does not restrict the movement of the operator and is also easily portable.

Another object of the present invention is to develop a joystick that is both pleasing and comfortable for the operator to use. For example, certain physical stops and limitations to the motion of the improved joystick have been eliminated in order to reduce the operator's fatigue. In addition, the present invention substantially reduces the operator training time required to develop the psychomotor coordination needed to use the joystick.

These and other objects are achieved by an improved joystick that includes an operator controllable handle and an inclination sensitive potentiometer The potentiometer includes an elongate resistance element and an inclination sensitive electrical wiper located in an arcuate passage. The wiper seeks the vertical and wipes along the resistance element as it is moved during operation. The point of contact between the wiper and the resistance element determines the electrical conductivity of the resistance element and the output of the potentiometer.

To provide control commands, the operator tilts the control handle in the desired direction. This tilting causes the resistance element in the potentiometer to move with respect to the vertical. The inclination sensitive electrical wiper seeks the vertical and wipes the resistance element as it moves. The position of the electrical wiper with respect to the resistance element determines the output resistance of the potentiometer.

Additional objects and features of the invention will appear from the following description in which the preferred embodiment has been set forth in detail in conjunction with the accompanying drawings.

DESCRIPTION OF THE PREFERRED EMBODIMENT

Figure 1:
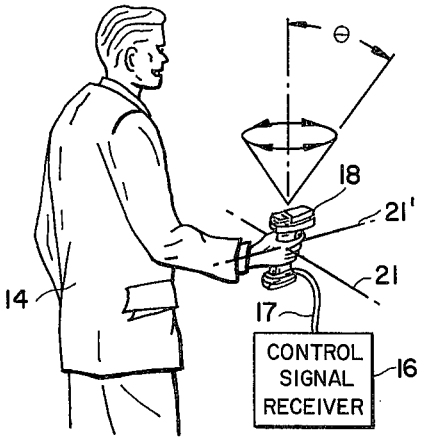
FIG. 1 is a diagrammatic view of the improved potentiometer joystick of the present invention as shown in use.
Figure 2:
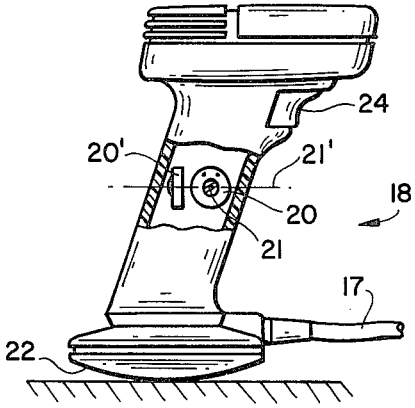
FIG. 2 is a side elevation view, partially cut away, of the joystick of FIG. 1 illustrating the positioning of two potentiometers.

FIGS. 1 and 2 illustrate the improved potentiometer joystick according to the present invention. The joystick is held by an operator 14 and is connected to a control signal receiver 16 by a control cable 17. The control signal receiver is of known construction and does not form part of the present invention. The joystick includes a control handle 18 which is gripped by the operator and a convex tilting surface 22 on the butt of the handle. This convex surface can engage and be rocked about horizontal surfaces during operation of the apparatus.

The control handle 18 also has a trigger 24 that can be actuated by the operator and that provides commands to the signal receiver 16 for other purposes.

Located within the control handle 18, FIG. 2, are two inclination sensitive potentiometers 20, 20' which are each electrically connected to the signal receiver 16. Each potentiometer has an input axis 21 about which it measures inclination as described below. The potentiometers are mounted so that the input axes are perpendicular to each other and lie in a horizontal plane when the control handle is upright.

One specific application of this potentiometer joystick is in the remote control of video games. In these games symbols are displayed on the access of television sets and the motion of the symbols is remotely controlled by the players. When used to control video games, the joystick 18, FIG. 1, produces operator control commands that are translated into direction signals that displace the operator controllable video images.

It should be appreciated from FIG. 1 that the joystick 18 need not be rocked about a fixed mounting surface and the operator 14 is capable of free and substantially unrestricted movement of his arm. When controlling video games, this apparatus permits the operator to walk around in front of the television set. The apparatus can also be positioned on horizontal surfaces such as coffee tables and can be tilted without limitation about the convex surface 22 in order to generate displacement commands.

Figure 3:
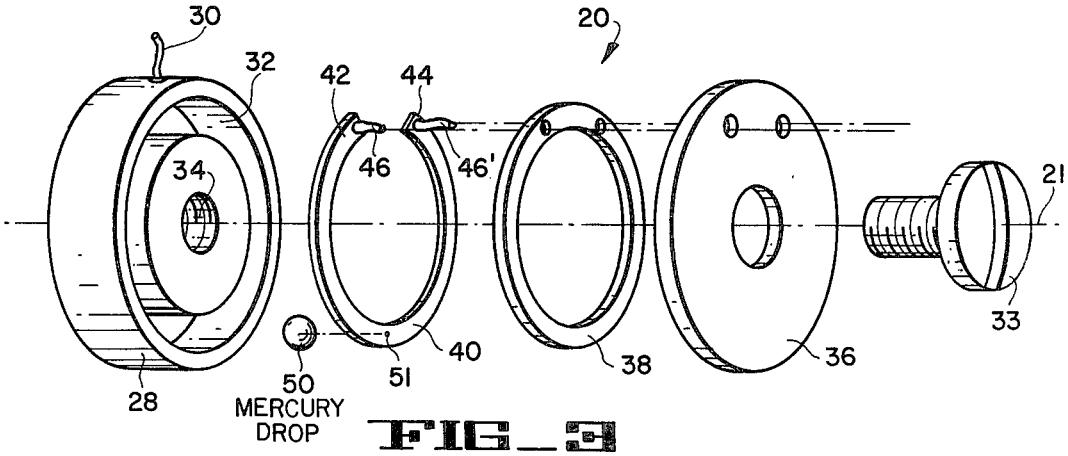
FIG. 3 is an exploded view of one embodiment of the improved potentiometer according to the present invention.
Figure 5:
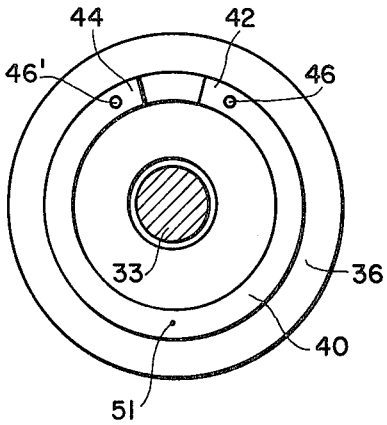
FIG. 5 is an end elevational view in section taken along line 5—5 of the potentiometer of FIG. 4.
Figure 4:
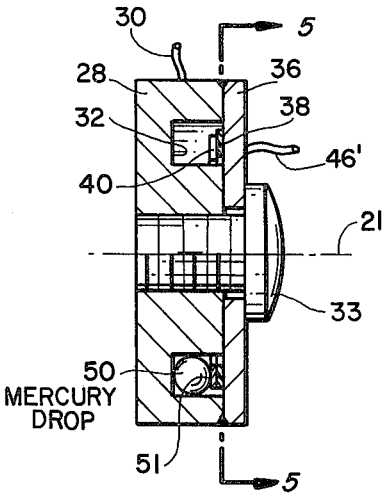
FIG. 4 is a side elevational view in section of the potentiometer of FIG. 3.

Referring to FIGS. 3–5, the inclination sensitive potentiometer 20, which is located within the control handle 18, includes an electrically conducting body 28. The body has an arcuate passage or channel 32 cut in its face and within which is contained the principle components of the potentiometer. In the preferred embodiment the channel has a rectangular cross-section, FIG. 4, and is circular in shape. The body is electrically connected to the control signal receiver 16 by a lead 30 which passes through the control cable 17. The body is rigidly attached to the control handle by a mounting bolt 33 which also engages the internal threads 34 on the body.

The channel 32, FIG. 4, in the body 28 is sealed by an electrically conductive cover 36. This cover is welded to the body and hermetically seals the channel 32. Mounted on the inside surface of this cover is an insulating substrate or ring 38. The insulating ring is fabricated from an insulator and is attached by suitable means. The insulating ring electrically isolates an elongate resistance element 40 from the walls of the channel 32 and the cover 36. In the preferred embodiment the elongate resistance element is a thick film polymer resistive trace. Such films are commercially available from the Methode Development Company of Chicago, Illinois, and are used for fabricating resistors directly on printed circuit boards. In the preferred embodiment the resistance element has a uniform resistivity along its length so that linear variations in conductivity are obtained. The polymer resistive trace can also be applied as a non-uniform film so that non-linear and exponential variations in conductivity can be obtained. The resistance element is electrically connected to the control signal receiver 16 at points 42, 44 by two leads 46 and 46'. These leads pass through the insulating ring 38 and the cover 36, and are electrically isolated from both.

The potentiometer 20, FIG. 3, also includes an inclination sensitive conductive liquid wiper 50 which always seeks the vertical. In the preferred embodiment this wiper is a small drop of mercury. The size of the drop of mercury, the width of the resistance element 40 and the dimensions of the channel 32 are such that the drop of mercury freely flows in the channel as well as continously remains in electrical contact with both the body 28 and the resistance element 40. The mercury drop electrically connects the resistance element 40 to the body 28 at the point of contact 51 as illustrated in FIG. 4. Two electrical circuits are thus formed within the potentiometer 20. One circuit includes the lead 30, the body 28, the drop of mercury 50, the segment of the resistance element 40 between the point of contact 51 and the end point 42, and the lead 46. The other circuit includes the body 28, the mercury drop, the segment of the resistance element between the point of contact 51 and the other end point 44, and the lead 46. The resistance value of each circuit in the potentiometer is proportional to the length of the associated segment. The segment lengths are determined by the position of the contact point of the mercury drop 50 with respect to the end points 42 and 44 of the resistance element. In the preferred embodiment the total resistance between these end points was 1 MΩ and the output resistance in one of the above described circuits linearly varied from 1kΩ to 1 MΩ.

The body 28 and the cover 36 are fabricated from an electrically conductive material as well as one that minimizes oxidation within the potentiometer. In the preferred embodiment the body 28 and the cover 36 are fabricated from either plated steel or stainless steel. During fabrication of the potentiometer the atmosphere within the channel 32 is flooded with an inert gas such as argon and the oxygen is removed. An inert gas is used in order to minimize oxidation of the mercury 50 and to maintain low contact resistance among the components.

In operation, two potentiometers 20, 20', FIG. 2, are mounted in the control handle 18. When the handle is upright, the input axis 21, 21' of each potentiometer is horizontal and the two axes are perpendicular with each other. The leads 30, 46, 46' from each potentiometer are connected within the control signal receiver 16 to a voltage dividing network (not shown) that measures the variations in the output resistances. Such networks are well known and do not form part of the invention.

When the potentiometer 20 is used to control a video game, inclination of the control handle 18 in the direction of the trigger 24, FIG. 2, about the convex surface 22 corresponds to a forward command. This is clockwise rotation of the control handle as illustrated in FIG. 2. The drop of mercury 50 remains in the bottom-most section of the arcuate channel 32, and the resistance element 40 attached to the body 28 generally rotates about the input axis 21, FIG. 1. This motion causes the end point 44 to move more closely to the drop of mercury and the distance between the electrical contact point 51 and the end point 44 to decrease.

The above described motion causes the length of the segment of the resistance element 40 between the contact point 51 to the end point 44 to decrease and the length of the other segment of the resistance element between the contact point 51 to the end point 42 to increase. A decrease in the length of one segment of the resistance element is seen by a voltage divider circuit (not shown) connected thereto as a decrease in the output resistance of the potentiometer. An increase in the length of one segment of the resistance element is seen by a voltage divider circuit connected thereto as an increase in the output resistance of the potentiometer. The change in the output resistance of the potentiometer 20 is converted by the control signal receiver 16 into a forward command to the video game control circuitry (not shown).

Since for the same inclinaton of the potentiometer a decrease in the length of one segment of the resistance element is exactly matched by an increase in the other segment, only one voltage divider circuit is needed for each potentiometer. This one divider circuit can, of course, be connected to either segment.

A rearward command is given when the operator 14 rotates the control handle 18 toward himself about the convex surface 22. This motion causes counter-clockwise rotation of the potentiometer 20, as illustrated in FIG. 2, about its input axis 21. The drop of mercury 50 remains in the lowest section of the arcuate channel 32 and the end point 42 moves closer to the mercury drop. Thus, the distance between the electrical contact point 51 of the mercury drop and the end point 42 is decreased while the distance between the end point 44 and the contact point is correspondingly increased.

This rearward motion of the control handle causes the length of the segment of the resistance element 40 between the contact point 61 to the end point 44 to increase and a voltage divider, if connected thereto, to see an increase in the output resistance of the potentiometer. The length of the segment of the resistance element between the contact point 51 and the other end point 42 is also decreased. If a voltage divider circuit is connected to this segment, a decrease in the output resistance of the potentiometer is observed. The control signal receiver 16 converts this change in output resistance into a rearward command.

Left and right commands are generated by rocking the control handle 18 in those directions. This motion is registered by the potentiometer 20' about the input axis 21'. The operation and construction of potentiometer 20' is exactly the same as described above.

Combination commands such as a forward-right and rearward-left are given by motion of the control handle 18 about both potentiometer input axes 21, 21' concurrently. Each potentiometer senses the component of inclination resolved along its input axis and generates a corresponding output resistance. The control signal receiver 16 converts these concurrent output resistance changes into the desired combination command.

It should be appreciated that although the potentiometer 20 is illustrated and described as being installed in a portable control handle 18, these potentiometers can be installed in a fixed base-type joystick. For example, these potentiometers can be attached to the lower end of the operating shaft of a ball and socket type joystick in place of the conventional potentiometers and linkage. In addition, the channel 32, FIG. 3, in the body 28 can be coated with materials that either aid or inhibit the flow of the mercury drop 50. The use of these materials can provide either a more sluggish or a livelier actuation of the potentiometer.

The present invention also contemplates the use of a non-conductive cover 36. Such a cover would eliminate the need for an insulating ring 38 to isolate the resistance element 40 from the body 28. The cover itself would do the insulating and can be fabricated from thermo-setting plastic.

Thus, although the best mode contemplated for carrying out the present invention has been herein shown and described, it will be apparent that modification and variation can be made without departing from what is regarded as the subject matter of the invention.

What is claimed is:

1. An inclination sensitive type joystick, comprising:

(a) a handle controllable by an operator of the joystick, said handle having a convex tilting surface for engaging substantially horizontal surfaces during operation;

(b) a first inclination sensitive potentiometer mounted within said handle and having an electrically conductive fluid wiper, an elongate resistance element in wiping relation to the wiper, said fluid and resistance element being located within the potentiometer, and electrical leads operatively connected to the fluid and the resistance element to form a potentiometer circuit;

(c) a second inclination sensitive potentiometer mounted within said handle and having an electrically conductive fluid wiper, an elongate resistance element in wiping relation to the wiper, said fluid and resistance element being located within the potentiometer, and electrical leads operatively connected to the fluid and the resistance element to form a potentiometer circuit; and (d) means for attaching said first and second potentiometers to said handle so that displacement of the handle is resolved into corresponding output resistance values.

* * * * *